US005667022A

United States Patent [19]

Güde

[11] Patent Number: 5,667,022

[45] Date of Patent: Sep. 16, 1997

[54] HYDRAULIC IMPACT DEVICE WITH CONTINUOUSLY CONTROLLABLE IMPACT RATE AND IMPACT FORCE

[75] Inventor: Dieter Güde, Essen, Germany

[73] Assignee: Deilman-Haniel GmbH, Dortmund, Germany

[21] Appl. No.: 460,219

[22] Filed: Jun. 2, 1995

[30] Foreign Application Priority Data

Jun. 3, 1994 [DE] Germany ..... 44 19 499.4

[51] Int. Cl.[6] ..... B25D 9/22

[52] U.S. Cl. ..... 173/105; 173/206

[58] Field of Search ..... 173/206, 207, 173/208, 105, 17, DIG. 4, 115

[56] References Cited

U.S. PATENT DOCUMENTS

| | | | |
|---|---|---|---|
| 3,995,703 | 12/1976 | Wanner | 173/105 |
| 4,211,291 | 7/1980 | Kellner | 173/DIG. 4 |
| 4,460,051 | 7/1984 | Widmer | 173/208 |
| 4,694,912 | 9/1987 | Glaser | 173/115 |
| 5,010,963 | 4/1991 | Neroznikov et al. | 173/208 |
| 5,056,606 | 10/1991 | Barthomeuf | 173/208 |
| 5,415,240 | 5/1995 | Mundjar | 173/206 |

FOREIGN PATENT DOCUMENTS 2206014 8/1973 Germany .

*Primary Examiner*—Scott A. Smith
*Attorney, Agent, or Firm*—James Creighton Wray

[57] ABSTRACT

An impact device 1 that is continuously controllable in terms of impact rate and impact force contains a percussion piston 25 that can move back and forth in the inner boring of the cylinder 3, and that is controlled via a rotary valve 15 having as rotary engine 16. The rotary valve 15 and the rotary engine 16 are positioned separately from the percussion piston 25, either on or in the cylinder 3, and are linked only via portings 20, 22, 24 to the pump connection 21 and the tank connection 23, or to the double-sided piston areas A1, A2, so that the valve can be used with practically any type of impact device, without requiring substantial alteration of its structural dimensions. In addition, an advantageous continuous control of impact rate and impact force with a constant power output is ensured.

14 Claims, 5 Drawing Sheets

201
202
203
204
205
206
207
208
209
210
211
213
214
215
218
219
220
221
222
223
247
248
249
250
251
252
253
254
255
257
258
260
261
262
263
265
268
269
270
271
272
273
276
277
278
279
281
282
283
P1
P2
P3
I
II
-
+

HYDRAULIC IMPACT DEVICE WITH CONTINUOUSLY CONTROLLABLE IMPACT RATE AND IMPACT FORCE

BACKGROUND OF THE INVENTION

The invention involves a hydraulic impact device that has a cylinder which holds the end of the tubing and contains the turning gear for the tubing, and which contains a percussion piston that acts upon the tubing and can move back and forth inside an inner boring; the percussion piston is controlled via a control system that contains rotary valves driven by a rotary engine.

One hydraulic impact device of this type is known-in-the-art from DE-OS 22 014.6. In this impact device, the component that is necessary for the gear reversal is the rotary valve that surrounds the actual percussion piston. In addition to a costly control system, it is a significant disadvantage of this device that its structure requires it to be of sizeable dimensions. It is an additional disadvantage that, with the control system that is used, the power output changes with changes in the impact rate and impact force, so that the control system as a whole is relatively imprecise. The same is true for the device specified in DE-OS 43 28 278.4, in which again the rotary valve is arranged around the percussion piston. In this device the rotary valve is driven via a rotary engine, which simultaneously serves in the displacement of the tubing, in which a shifting of the interlocking gearwheels also enables a separation of the rotary valve mechanism from the turning gear of the tubing. Thus this device contains both mechanical connections and toothed wheel works, which in turn also results in increased manufacturing costs as well as a certain variation of impact rate, impact force, and impact power output. More importantly, however, it is not possible to produce extension borings or to use the device with different hammers having different values, because the device, which has been manufactured as a complete unit, must be operated as such.

SUMMARY OF THE INVENTION

It is thus the object of the invention to create an impact device that contains a control system that can be simply and easily adjusted to meet different requirements.

The object is attained in accordance with the invention in that the rotary valve and the accompanying rotary engine are mounted on or in the cylinder separately from the percussion piston, and are linked to the pump and tank connections or to the two-sided piston areas only via portings. Contrary to state-of-the-art technology, with this type of design it is possible for the device to be relatively small, because the rotary valve can be designed and positioned completely separately from the impact device that is being used. It does not surround the percussion piston, but instead represents a separate component that is connected to the percussion piston only via the corresponding portings, and is thus connected only hydraulically and not mechanically. The rotary valve itself is designed such that a change in or an adjustment of the entire impact device can be effected relatively quickly. In addition to the small structural form or small structural dimensions of the device, the rotary valve enables a continuous control of the impact rate and impact force while a constant power output is maintained. Thus, this type of impact device is not only widely applicable, it is also characterized by a very advantageous and effective control system.

One advantageous embodiment of the invention provides for the rotary valve to have a control cylinder, which can be detached from the cylinder. This separable connection of the control cylinder to the cylinder or the rotary valve, and ultimately the percussion piston, makes it possible for a control system of this type to be added to practically any kind of hammer, or to be operated by adapting it to the appropriate drilling layout. In this manner and means this rotary valve can be used even with large hammers, such as demolition hammers, as it is invariably small in its dimensions, which enables its use even in the case of large-scale equipment, because it can be used regardless of the structural dimensions of the percussion piston. It is a further advantage that extension borings can be produced with an impact device of this type, since the striking mechanism can be advantageously switched off and the mounting or connection of the next bore hole tubing can be correspondingly implemented, without disadvantages caused by the striking mechanism.

A further advantageous embodiment provides for the rotary valve to be enclosed by a control bushing that is positioned inside the control cylinder and that contains control openings that are designed to correspond to the control openings that are provided for in the rotary valve, which are designed as piston ports; these control openings are themselves linked to the portings that lead to the pump and tank connections. The control bushing that encloses the rotary valve makes it possible for the connection with the proper porting to be maintained, while the rotary valve rotates, without leakages or other similar problems occurring. More importantly, as soon as the proper control openings move forward to their positions in front of the corresponding control openings in the control bushing, the hydraulic pressure medium appears in the appropriate porting, or it can flow off through the appropriate porting, relieved of pressure. This permits control to be very precise, very rapid, and such that the power output will remain constant. In addition, the control openings, both in the rotary valve and in the control bushing, are coordinated with one another in terms of their dimensions, so that the quantities of hydraulic fluid that are necessary for the triggering and implementation of the control process are always immediately available. The design of the control openings as piston ports allows the point of actuation or the specific opening point for the control openings that are used to be precisely predetermined.

In order to allow the rotary valve itself to also be acted upon varyingly, in other words set into rotation, according to the required conditions, the invention provides for the rotary engine of the rotary valve to be separably connected to the control cylinder and to be continuously adjustable. This permits the rotary engine to be exchanged exclusively, within the shortest possible period of time, so that the capacity of the rotary valve being used can also be easily adjusted to meet current requirements. Because the rotary engine is continuously adjustable, the impact device can be relatively simply adjusted to meet changing conditions.

The rotary valve is both fast enough and capable of providing the necessary quantities [of hydraulic fluid]; the control openings that are at the end of the rotary valve that lies opposite the rotary engine, and that connect the rotary valve to the porting that leads to the percussion piston, are designed as bore holes. The bore holes open up somewhat more slowly than the longitudinal ports in the rotary valve, but they are sufficient, because the hydraulic pressure fluid must first penetrate into the inner porting of the rotary valve, with the inner porting consisting of a pocket boring in the rotary valve. The hydraulic pressure fluid travels through this pocket boring from the rotary valve into the porting, and enough hydraulic pressure fluid is present in the porting to allow the necessary pressure to build up within a relatively short period of time.

In order to provide a percussion piston that has the greatest possible amount of striking force, the invention provides for the percussion piston to be equipped with two piston rings that are positioned at a specific distance from one another; the piston ring that is positioned farthest from the striking end, which is shaped like a truncated cone, has a larger surface area than the piston ring that is closest to the striking end, and the area of the latter piston ring is permanently linked, via the porting, to the pump connection. This special design and the permanent linkage with the pump connection ensure that the percussion piston will always be retracted quasi-automatically to its upper position after it has reached its lower position, because the pump pressure has a correspondingly immediate effect. The percussion piston itself is correspondingly long, but can still be blocked easily and over relatively short distances, if the piston rings are appropriately designed and positioned in relation to one another. The two piston rings also have the advantage that, with the quasi-retention of the diameter of the boring inside the cylinder, only the upper end piece of the piston need be tapered somewhat in order to create the different piston areas.

As was specified above, the percussion piston is designed to have two piston rings in order to permit the percussion piston to be correspondingly long. In order to permit the pressure cushion, particularly on both on both [sic] sides of the piston ring that is closest to the striking end of the piston, to be rapidly and precisely reduced, the invention, as seen from the side view, provides for both sides of the piston ring that is permanently linked to the pump connection to also be connected to a pressure relief boring. This allows the pressure cushion, which would otherwise build up around whatever piston ring is lower at a given time to be reduced rapidly enough, in both the upstroke and the downstroke, to prevent any obstruction of the movement of the percussion piston. These pressure relief borings lead into the porting that leads to the tank connection, so that the released fluid can be drained off and removed from the cylinder rapidly.

In order to permit the monitoring of the pressure ratios in this type of impact device, continuously if necessary, the invention provides for the portings that lead to the pump and tank connections, as well as to the percussion piston, to be additionally connected via tap holes to the outer wall of the cylinder. This allows a measuring device to be affixed at any time, which can precisely monitor the quantities [of fluid] and, more importantly, the level of existing pressure. If these types of measurements are temporarily considered unnecessary or are not desirable, then the tap holes on the outer wall of the cylinder can easily be closed to prevent any leakage in this area. Naturally, it is also theoretically possible for a hose coupling to be connected to these tap holes, which would direct the outflowing pressure fluid back to the tank without harmful effects to the environment.

With impact devices of this type, strong vibrations can occur, which lead to an undesirable displacement. This is now prevented in accordance with the invention in that the control system containing the rotary valve and the rotary engine is equipped with a centralized lubricating system, which is controlled by a valve that has a pilot valve; the valve contains an output lever that is located between the input lever and the tappet, and that on the one hand is designed to alternatingly act upon the tappet or be acted upon by the tappet, and on the other hand is acted upon by a blocking element that is guided by a quadrant and is linked to the input lever, with the blocking element being comprised of several blocking units that can be shifted in relation to one another. With a hydraulic pilot valve of this type, the pilot unit remains completely unchanged. A control unit is affixed either on or near this pilot unit, the control unit being designed to prevent any unintentional displacement, even under the strongest vibrations. The force that acts on the tappet and the spring causes the output lever to be arrested so that the valve can no longer be unintentionally displaced. More importantly, it is necessary to actuate the input lever in order to release the output lever, and in order to intentionally displace the pilot valve. This type of pilot valve is based upon an element that in principle is known in the art, which was originally developed and used as a self-locking mechanical element for aircraft control systems. In using this, the restoring force is automatically blocked without the use of lever braces, catches, friction blocks, etc., which causes the self-locking mechanism to become more secure the higher the restoring force is. With the blocking units that can be shifted in relation to one another, the desired blocking by the tappets or the appropriate springs occurs to such an increased extent that the output lever is effectively arrested, even under extreme conditions.

An improved two-speed engine is used for the turning gear in order to guarantee an automatic switching to the most favorable mode at any given time; the turning gear for the tubing is driven by a two-speed, automatic transmission rotary engine, whose pilot valve contains a control valve, via which the control valve [sic] receives a continuous supply of control oil, and whose motor contains a control line having one manometric switch that is set at a lower pressure of P1, and another manometric switch that is set at an upper pressure of P2, whereby each of the manometric switches is connected to the control valve via an all-or-nothing relay that is connected to an adjustable time-lag relay having a lock. This makes it advantageously possible for the hydraulic motor to be operated fully automatically and for it to switch automatically to the most favorable mode at any given time without requiring manual intervention. The control valve is always actuated via the manometric switch or the appropriate relay, precisely at that point in time at which, for example, the pressure has dropped or has increased substantially, necessitating a shift. Since the individual pressure levels are precisely adjusted, a corresponding shifting at the optimum point in time results; the negative stop-and-go effect cannot occur, because the time-lag relay with a lock ensures that, even in the case of changing pressure conditions occurring as a result of the shifting process, the position that has been selected is maintained for a specific period of time. Thus, the above-described stop-and-go problems can no longer occur during shifting into the HT/LS mode or into the HS/LT mode.

An embodiment of this type contains a hydraulic/electronic switch, but a purely hydraulic switch may also be used, in which case the manometric switches are designed as hydraulic pressure valves that are regulated via the force of springs, and are connected via a hydraulic relay valve to the control valve; these pressure valves are also equipped with a reservoir and an adjustable throttle. In this case, although somewhat more switching is required, a shifting at the precise point in time is ensured with the same certainty.

Hydraulic engines of this type are manufactured such that they can be used in either rotational direction, so it is advantageous for a shuttle valve to be integrated into the control lines. With such a shuttle valve, the pressurization of the control line can be ensured in both rotational directions of the hydraulic engine.

The control valve, which is vital for use of the device and which contains the pilot valve, can be advantageously implemented in that the control valve contains a spring, which at rest is in the off position, and a solenoid. The spring automatically brings the control valve into position, and an even pressurization of the pilot valve with control oil is ensured, while the application of electrical current to the solenoid causes the valve to be switched against the force of the spring, so that the control oil cannot affect the pilot valve, which automatically results in the changing of the hydraulic setting.

A potentially necessary manual switching of the hydraulic motor is possible, as one possible embodiment of the invention contains a mode selector that has both automatic and manual switching mechanisms, with the individual switching positions being indicated via luminous diodes.

The invention is specifically characterized in that an impact device is created, which is simple in design, but is also very precise and certain in its control. The rotary valve enables the continuous control of both the impact rate and the impact force, while a constant power output is maintained. The small structural dimensions have already been mentioned, with these reduced dimensions being achieved specifically by positioning the piston [sic] outside of the cylinder, and thereby separately from the percussion piston. This external positioning also brings with it the above-mentioned advantage of enabling a high degree of adjustability, which also provides advantages if repairs become necessary. Advantageously, every mechanical connection between the moving parts can be omitted. More importantly, the control process is effected exclusively on the basis of non-mechanical connections. The control process as such can be connected and correspondingly adjusted to fit practically any drilling hammer with any drilling layout, which results in a high degree of adaptability. It is a further advantage that large-scale hammers may also be fitted with this type of rotary valve, whereas up to now, due to the enormous dimensions of the percussion pistons and the rotary valves that would encompass them, they simply could not be used, this being due both to the control and the large dimensions. In addition to the precise closing values and opening values produced by the special design of the rotary valve, it should also be emphasized that with a rotary valve of this type or with a device of this design, extension borings can also be produced without difficulty, because the striking mechanism can be switched off during the extension process, such that, with the help of the turning gear, a connection or disconnection of the individual tubes in the tubing results. In order to optimize the impact device, a centralized lubricating system, which can be controlled via a valve that contains a pilot valve, is also included, so that even under the strongest vibrations, an unintentional displacement of the control device or the pilot device cannot occur. This involves a special design for the automatic transmission, in which the force of the output lever that is exerted upon the tappet via the spring is arrested, such that the valve cannot be unintentionally displaced. The turning gear of the tubing, which ensures the even rotation of the tubing, is equipped with a secured, two-speed, automatic transmission, which always ensures an automatic shifting at the most favorable pressure condition.

Further details and advantages of the object of the invention are discussed in the following description of the attached diagrams in which a preferred exemplary embodiment containing the necessary features and individual components is illustrated. The diagrams show:

DETAILED DESCRIPTION OF THE PREFERRED EMBODIMENTS

Figure 1:
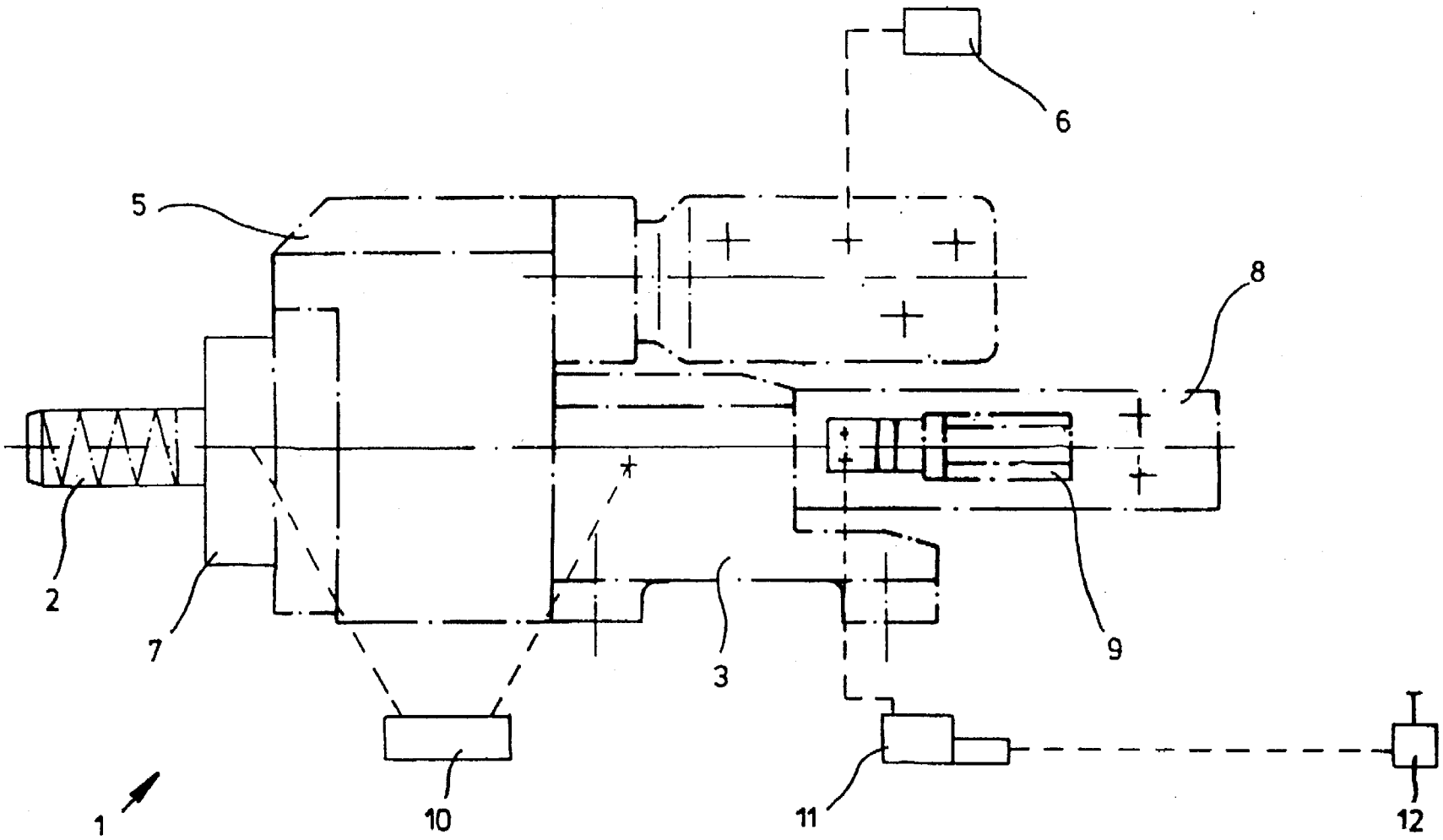
FIG. 1 a sketched rendition of an impact device.

FIG. 1 shows a schematic representation of an impact device 1, in which the tubing 2 is only sketched in outline, in this case in the form of the impact rod that is to be connected to the tubing 2 and inserted into the cylinder 3. This tubing 2, or the impact rod, is rotated by the turning gear 5, so that the bore crown that is located on the opposite end of the tubing is continuously brought into a different striking position, each time before the striking mechanism e is activated. The return stroke device is indicated by the number 7, and the so-called two-speed automatic transmission, which controls the rotary engine of the turning gear 5, is indicated by the number 6.

The control system is generally indicated by the number 9 and is used for the shifting of the percussion piston, which is not illustrated here. The control system 9 is comprised of the control cylinder, the rotary valve, and the rotary engine.

The centralized lubricating system 10 serves in the lubrication of the impact device 1. The valve 11, which is designed as a proportional valve, controls the quantity of oil going to the driving motor for the striking mechanism control system, and the hydraulic pilot valve 12 in turn controls the valve 11.

Figure 3:
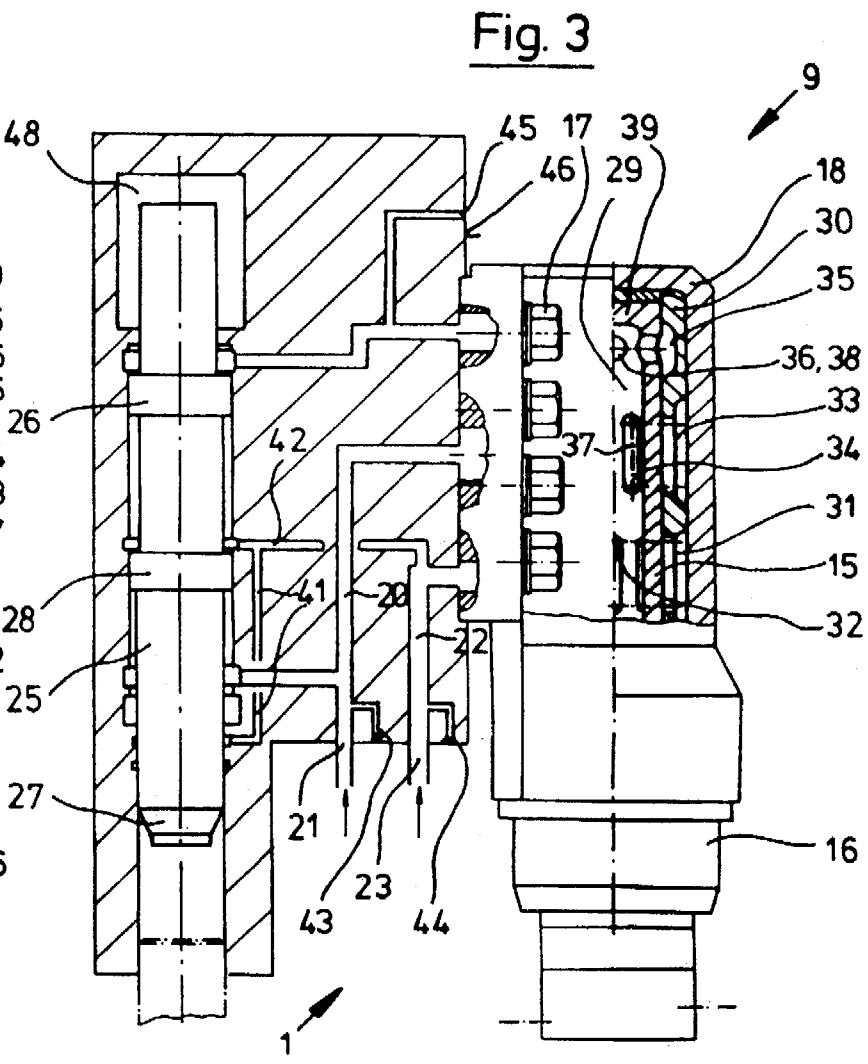
Figure 2:
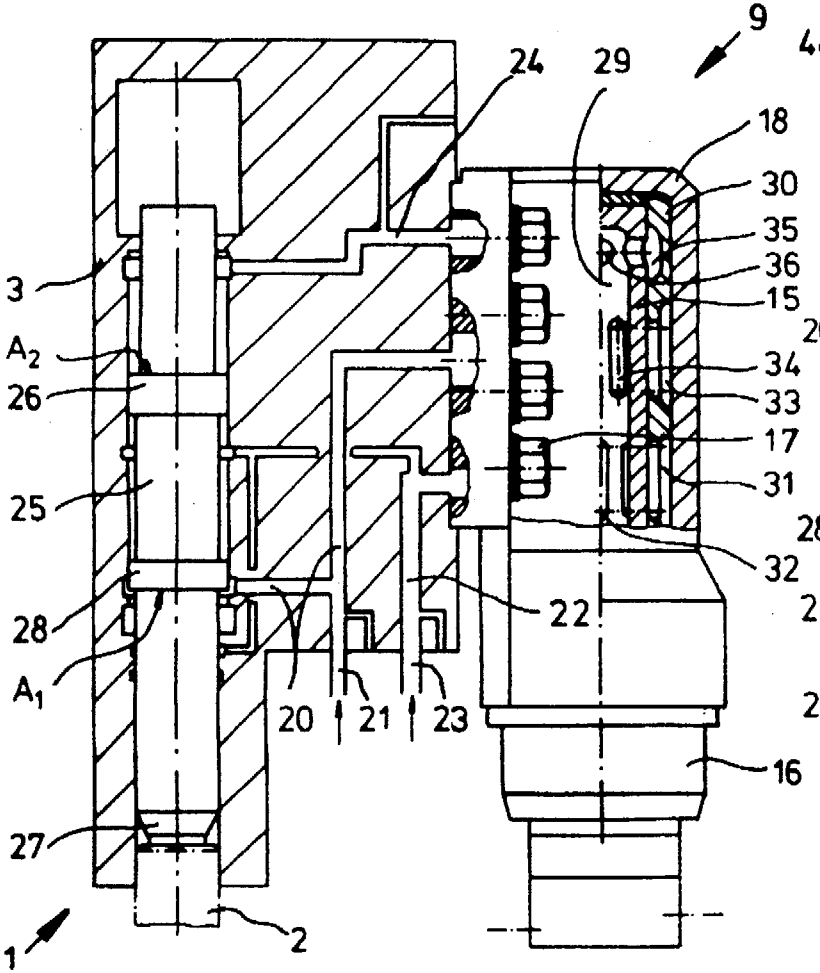
FIG. 2 a cross-section of the impact device when it has reached its lower end point and FIG. 3 the cross-section in accordance with FIG. 2, with a percussion piston that has been restored to its end point, FIG. 4 a diagram of connections (control system) for the hydraulic motor, FIG. 5 a diagram of connections for the hydraulic control system of a hydraulic motor having two switching stages and FIG. 6 a frontal view of a pilot valve.

FIGS. 2 and 3 show a cross-section of the control system 9 with the rotary valve 15 of the rotary engine 16, here in the form of a hydraulic driving motor, as well as the control cylinder 18 that is connected to the cylinder 3 via securing screws 17.

Inside the control cylinder 18 is a porting 20 that leads from the pump connection 21 to the control cylinder 18 or to the rotary valve 15, and a porting 22 that leads from the tank connection 23 to the rotary valve 15. A porting 24 connects the rotary valve 15 to the percussion piston 25.

The percussion piston 25 is designed in this instance to contain two piston rings 26, 28, with the piston ring 26 that is positioned farthest from the striking end 27 having a larger surface area A2 than the piston ring 28 having the surface area A1.

The rotary valve 15 rests in a control bushing 30, which is designed to be positioned inside the control cylinder 18 and to enclose the rotary valve. The control bushing 30 and the rotary valve 15 are designed to contain corresponding control openings 31, 32 and 33, 34. In addition, there is a control opening 35, 36 that is designed as a bore hole and is positioned in the end 39 that lies opposite the rotary engine 16.

The other control openings 31, 32, 33, 34 are designed as control supports 37 and are positioned opposite the bore hole 38 in the form of the control openings 35, 36, with these piston ports 37 and the corresponding slots providing the advantage that a very precise or specific opening point can be preset.

In addition, pressure relief holes 41, 42 are positioned in the cylinder 3, these being located on both sides of the piston ring 28, so that the pressure that builds up each time with the back and forth movement of the percussion piston 25 can be rapidly drained off. The pressure relief holes are thus connected to one another and to the porting 22, and thereby to the tank connection 23.

Furthermore, the cylinder 3 includes several tap holes 43, 44, 45, which provide a connection to the outer wall of the cylinder 46 for the portings 20, 21, and 24. These permit the pressure build-up in these portings, and thus in the area of the percussion piston 25, to be monitored at all times.

The pressure that is exerted at the pump connection 21, and thereby at the porting 20, moves the percussion piston 25 to the upper position by applying pressure to the surface area A1. At the same time, pressure is exerted on the rotary valve 15.

The rotary engine 16 shifts the rotary valve 15 into a rotational movement. This rotation causes a connection with the porting 24 to be made via the piston ports 37, in other words via the control openings 33, 34 and the inner boring 29. In this way, pressure is applied to the percussion piston 25 at its surface area A2.

Since the surface area A2 is larger than area A1, the percussion piston 25 is driven to the lower position, which is illustrated in FIG. 2. The further rotation of the rotary valve 15 now causes the control opening 33 to be closed. The connection between the pump connection 21 and the surface area A2 of the percussion piston 25 is broken. The connection between the surface area A2 and the tank connection 23 is now made via the control openings 31, 32.

Because hydraulic pressure is constantly being exerted on the surface area A1, the percussion piston 25 is moved to the upper position. Moved at the appropriate speed [sic]. With the corresponding speed of the rotary valve 15, the impact rate and the impact force of the percussion piston 25 are continuously altered, while the power output of the hydraulic striking mechanism remains constant.

Located at the end of the cylinder 3 that lies opposite the shank of the drill or the tubing 2, the upper end of the percussion piston 25 is positioned inside a chamber 48, which is filled with nitrogen, in accordance with state-of-the-art methods. The nitrogen is under pressure of approximately 10 bar.

Figure 4:
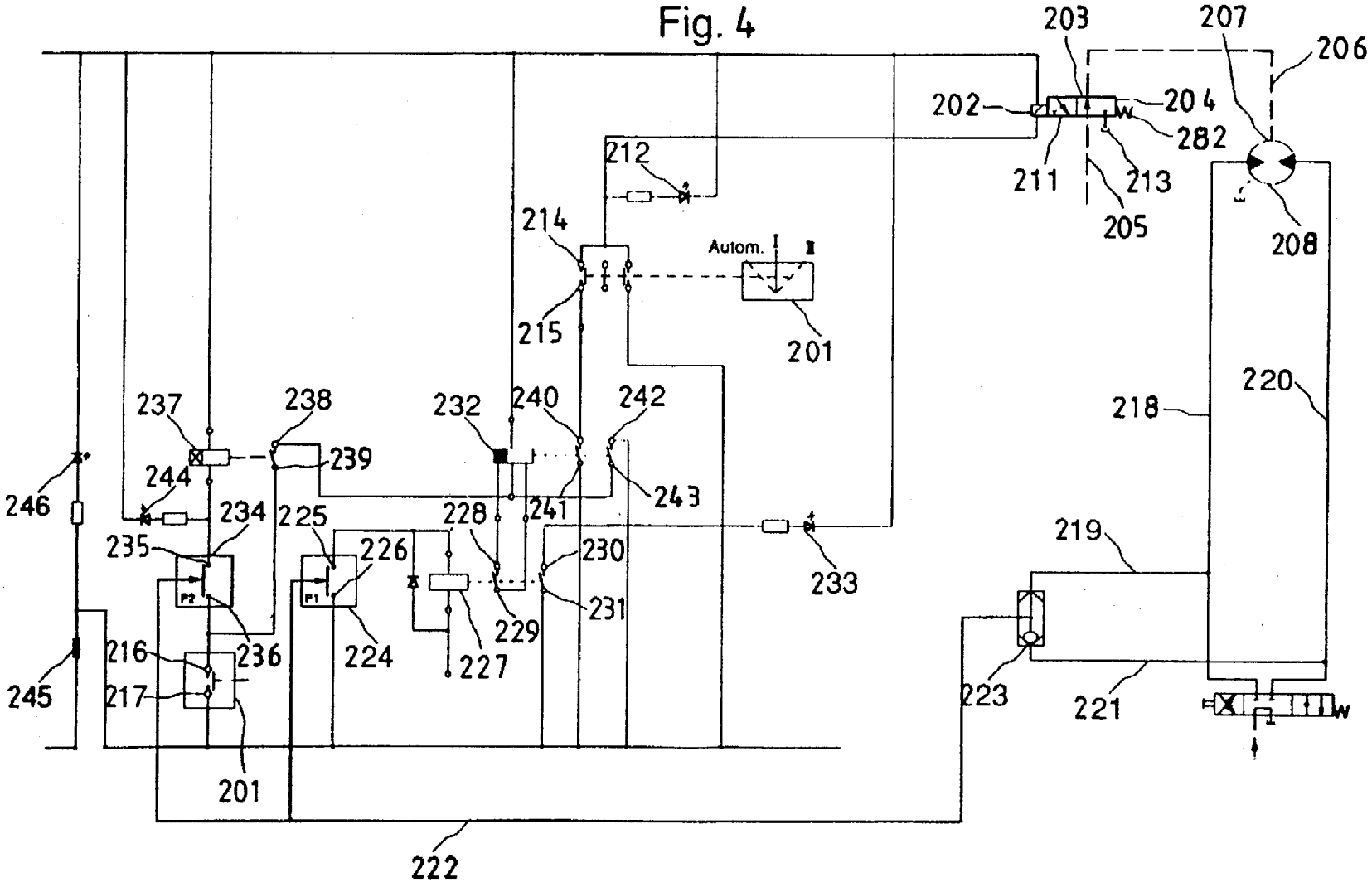

FIG. 4 shows a diagram of connections in which, approximately in the center, the mode selector 201 is illustrated; this mode selector can be used to activate several operating modes, specifically control position 1 with the manual operation of the HS/LT mode, control position 2 with the manual operation of the HT/LS mode, and finally automatic operation, which in this case is indicated as the two-speed automatic transmission 6. In the following specification, the two control positions 1 and 2 with manual operation, which are included only for exceptional cases, will be disregarded.

Thus the mode selector 201 is correspondingly switched to the two-speed automatic transmission position. The contacts 214, 215, and 216 and 217 of the mode selector 201 are closed, as is clearly illustrated in FIG. 4. In this control position, the solenoid 202 for the control valve 203 is without voltage. The control valve 203 is in the off position 204.

The free passage of the control oil via the control oil line 205, 216 to the pilot valve 217 of the hydraulic motor 208 is ensured. The pilot valve 207, which is acted upon by pressure from the oil of the control oil lines 205, 206, switches the hydraulic motor 208 to the HS/LT mode, which may also be referred to as the high-speed mode.

If the torque of the hydraulic motor 208 increases during operation, then the hydraulic pressure in the lines 218, 219 or 220, 221, and thus in the control line 222, increases, based upon the rotational direction of the hydraulic motor 208. The task of the shuttle valve 223 in the control line 222 is to ensure the pressurization of the line 222 for both rotational directions of the hydraulic motor 208. If the hydraulic pressure in the control line 222 reaches the pressure level P1 that is set at the manometric switch 224, then the contacts 225, 226 are closed, and the relay 227 is triggered, which closes the contacts 228, 229 and 230, 231. This is indicated by the luminous diode 233.

If a further increase in pressure caused by an increasing load of the hydraulic motor 208 causes the pressure level P2, which is set at the manometric switch 234, to be reached, then the manometric switch switches on the contacts 235, 236. This is indicated by the luminous diode 244. The time-lag relay 237 is then switched on. The contacts 238, 239 are then closed. This causes the time-lag relay 232 to be excited and the contacts 240, 241 and 242, 243 (lock of the time-lag relay 232) to be closed. Since the contacts 214, 215 and 216, 217 of the mode selector 201 are closed, the solenoid 202 for the pilot valve 203 is now connected to the power supply. The pilot valve 203 is switched to position 211. This is indicated by the luminous diode 212. The connection of the control oil lines 205, 206 to the pilot valve 207 of the hydraulic motor 208 is broken. The oil from the control oil line 206 between the pilot valve 203 and the pilot valve 207 of the hydraulic engine 208 is drained off to the tank 213. The pilot valve 207 of the hydraulic engine 208 is relieved of pressure. The hydraulic engine 208 is thus switched to the HT/LS mode.

The process of switching the hydraulic engine 208 from the HS/LT mode to the HT/LS mode causes the hydraulic pressure in the lines 218, 219 and 220, 221 (according to the direction of rotation of the hydraulic engine 208) and in the control line 222 to fall below pressure levels P1 and P2 that are set at the manometric switches 224, 234. The decrease in pressure in the lines is conditional upon the structure of such a hydraulic engine 208. The pressure level P2 of the manometric switch 34 [sic] is set at a maximum value that corresponds to the system. The pressure level P2 is greater than the pressure level P1. The manometric switch 234 opens the contacts 235, 236, and the voltage at the relay 237 decreases, opening the contacts 238, 239. The contacts 240, 241 and 242, 243 remain closed (lock of the time-lag relay 232). The contacts 225, 226 of the manometric switch 224 open. This causes the voltage at the relay 27 [sic] to decrease and the contacts 228, 229 and 230, 231 to open for the period of time T1 (the opening of the contacts 228, 229 causes the time-lag of the relay 232 to be activated). For at least this period of time T1, the lock of the relay 232 must be ensured, because otherwise the voltage at the solenoid 202 for the pilot valve 203 will decrease and the pilot valve 207 of the hydraulic motor 208 will again be switched to the HS/LT mode. This process of switching from the HT/LS mode to the HS/LT mode and back would then continuously repeat itself (stop-and-go effect). A continuous boring would be impossible. The integrated lock, however, prevents the stop-and-go effect. The lock is achieved via the time-lag relay 232, which is equipped with a time-lag device.

Figure 5:
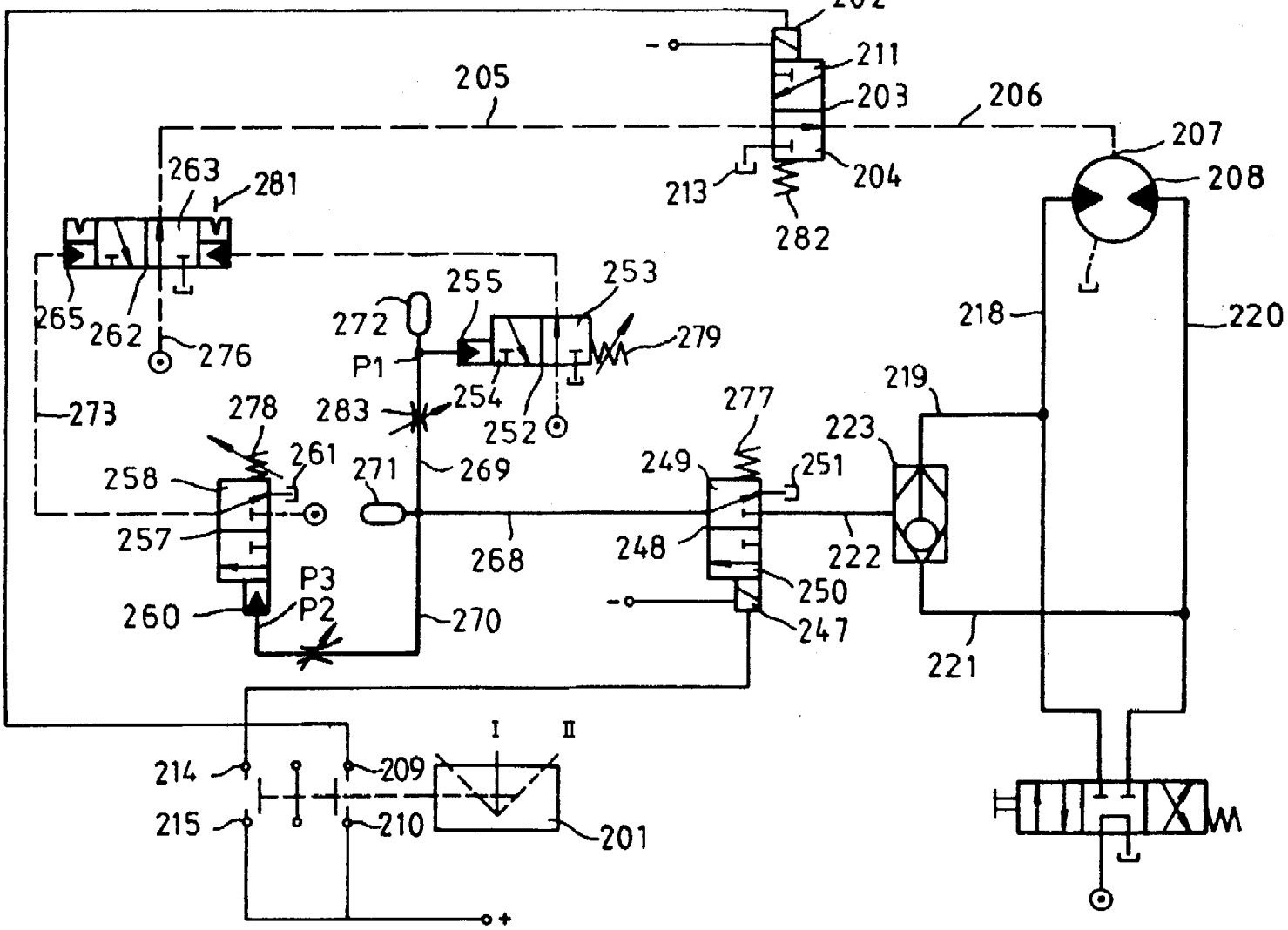

The diagram of connections for the hydraulically switched hydraulic motor in accordance with FIG. 5 corresponds extensively with that in FIG. 4. In this case, as before, the pilot valve 248 is free of voltage in the manual operation of the HS/LT mode of the solenoid 247. The pilot valve 248 is switched to the off position 249 via the spring 277. The hydraulic pressure that is present in the control line 222 during the operation of the hydraulic motor is blocked.

A further switching position is indicated by the number 250, the tank line is indicated by the number 251, a valve is indicated by the number 252, the off position is indicated by the number 253, and another position is indicated by the number 254. The pilot valve 248 switches to the position 250, the valves 203, 252 and 257 are in a position of rest, and the valve 262 is in the position 263. The lines 268, 269, 270, the hydraulic reservoirs 271, 272, and the circuit breaker assemblies 255, 260 are relieved of pressure via the tank line 251 when the pilot valve 248 is in the off position 249. The springs 278, 279 cause the valves 252, 257 to be brought to their off positions 253, 258. The off position of 257 causes the line 273 and the circuit breaker assembly 265 of the valve 262 to be relieved of pressure via the tank line 261. The valve 262 is switched to position 263 and is held there via the locking device.

The solenoid 202 for the pilot valve 203 is free from voltage. The valve 203 is switched via the spring 282 to the off position 204. A free passage of control oil to the pilot valve 207, which is acted upon by pressure via the control oil from the lines 276, 205 and 206, switches the hydraulic motor 208 to the HS/LT mode in accordance with FIG. 5.

Further explanation can be omitted here, since extensive coverage of the connection in accordance with FIG. 4 and FIG. 5 is given. Regarding the lock for the valve 252, position 254 should be mentioned, in that the locking is achieved via the hydraulic energy that is present in the reservoir 272 and the throttle 283 that can be set for the time period T1. The energy present in the reservoir 272 holds the circuit breaker assembly 255 of the valve 252 in the position 254 during the decrease in pressure in the switching phase from the HS/LT mode to the HT/LS mode, for the time period T1. With the adjustable throttle 283, the time period T1 of the lock is set. After the time period T1, the hydraulic power exerted on the circuit breaker assembly 255 is greater than the adjusted force on the spring 279. The valve 252 remains in the switched position 254. The maximum that is set in the hydraulic system can now be operated in the HT/LS mode. As is indicated above, FIG. 5 shows the outline of a hydraulically controlled hydraulic motor.

Figure 6:
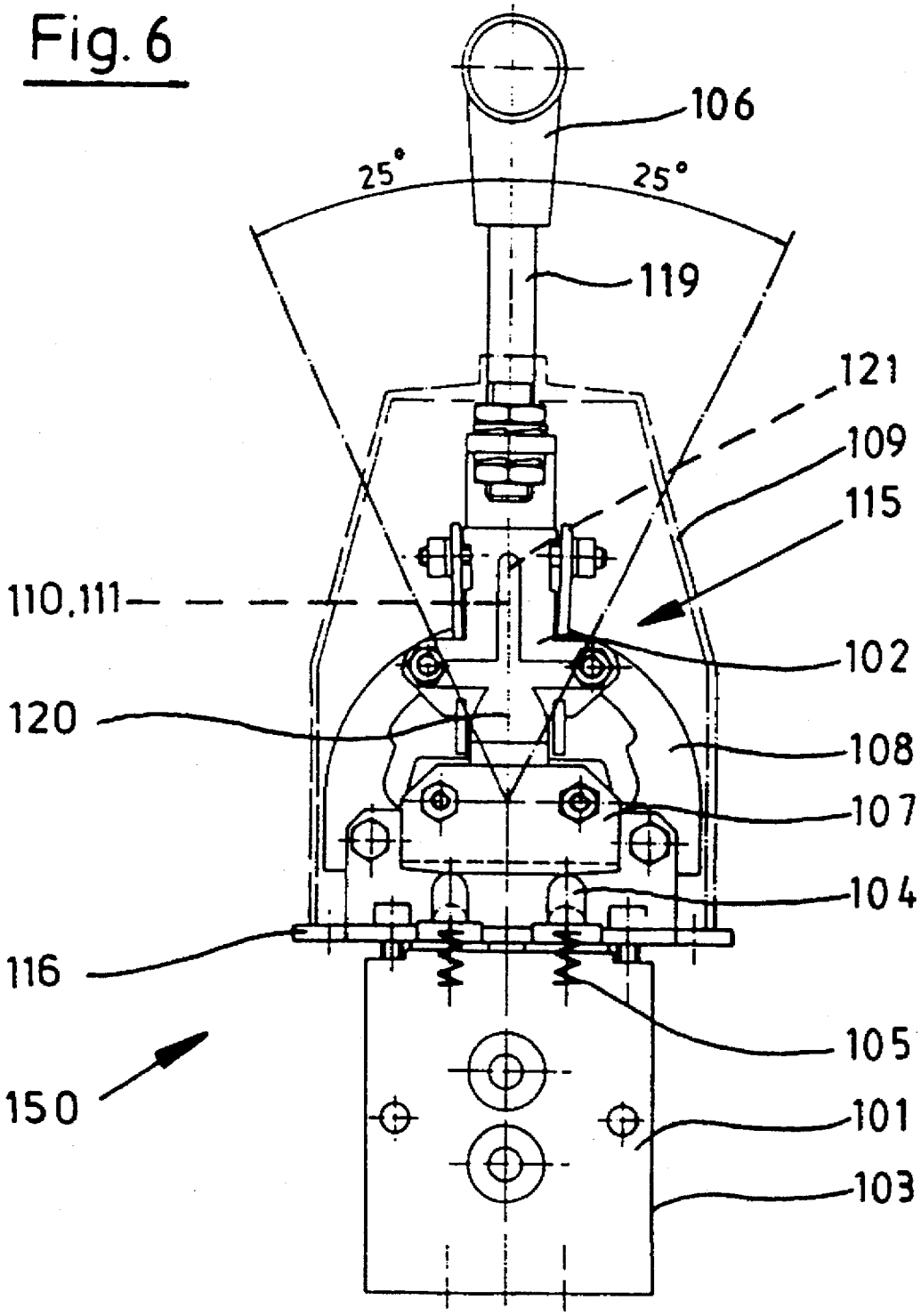

FIG. 6 shows a pilot unit 101 for the valve 11. This pilot unit 101 is comprised of the cylinder 103, from the top of which the tappets 104 protrude, and these are acted upon by springs 105. Positioned on top of the cylinder 103 is the control device 115 with the input lever 106, the blocking element 102, and the output lever 107, with the input lever 106 being guided by the quadrant 108, and able to be slewed 25° to either side. The entire controlling device 115 is covered with a rubber shell 109, which is fastened to the mechanism plate 116 and to the bar 119 of the input lever 106.

The blocking element 102, which is positioned between the input lever 106 and the tappets 104, is comprised of several blocking units 110, 111, which are pressed via the spring 105 and the tappet 104 into a locking position, making the operation of the pilot unit 101 impossible, unless it is actuated directly and intentionally via the input lever 106.

The blocking elements 110, 111, which are positioned inside the blocking element 102 such that they cannot be identified in the illustration in accordance with FIG. 6, are arranged such that they will act upon one another so that under contact pressure from the tappet 104 they swing into the blocking position. In so doing they slew around the center of rotation 120, which, as indicated, is positioned relatively far down, so that even with slight movements of the tappet or the tappets 104, the locking of the blocking units 110, 111 will result with certainty. This movement is supported by a pressure spring 121, which is not illustrated here, so that even in the case of relatively slight restoring forces, a blocking of the pilot unit or the pilot valve 150 will result.

All of the above-mentioned characteristics, including those that are found only in the diagrams, are viewed separately and as a whole as vital to the invention.

I claim:

1. Hydraulic impact device comprising a housing having a cylinder, a tubing having an end connected to the cylinder, a turning gear connected to the tubing, a percussion piston connected to the cylinder and movably positioned in an inner boring, said piston acting upon the tubing while moving back and forth in the inner boring, a control system for controlling the movement of the piston, a rotary valve provided in the control system, a first rotary engine connected to the rotary valve for driving the rotary valve, wherein the rotary valve and the first rotary engine are mounted separately from the percussion piston on the housing and removable therefrom, a pump and a tank connected to the system, plural portings connecting the first rotary engine to the pump and the tank and to the piston.

2. The device of claim 1, further comprising a control cylinder in the rotary valve, a connector for connecting the control cylinder to the cylinder.

3. The device of claim 2, further comprising a control bushing for enclosing the rotary valve, said control bushing being positioned inside the control cylinder, plural control openings in the bushing, and plural complementary openings in the rotary valve forming plural piston ports, said piston ports being connected to the plural portings connecting the rotary engine to the pump and the tank.

4. The device of claim 3, wherein the openings in the rotary valve are provided as bore holes.

5. The device of claim 1, wherein the rotary engine is separably connected to the control cylinder at continuously adjustable positions.

6. The device of claim 1, further comprising first and second piston rings on the percussion piston, said piston rings being positioned spaced from one another, the first piston ring being distal from a striking end of the piston, the second piston ring being positioned proximal the striking end and being connected to the porting attached to the pump, wherein a surface area of the first ring is greater than a surface area of the second ring.

7. The device of claim 6, further comprising a pressure relief boring, a line connected to the pressure relief boring and the second piston ring.

8. The device of 1, further comprising plural tap holes connected to the portings and to an outer wall of the cylinder.

9. The device of claim 1, further comprising a centralized lubricating system in the control system, a valve connected to the lubricating system, a pilot valve connected to the valve for controlling the valve, an output lever in the pilot valve positioned between an input lever and a tappet in the pilot valve, wherein the pilot valve alternately exerts pressure on the tappet and receives pressure from the tappet, a blocking element in the valve, a quadrant for guiding the blocking element, said quadrant being connected to the input lever, plural blocking units in the blocking element being movable in relation to one another.

10. The device of claim 9, wherein the turning gear for the tubing comprises a second rotary engine, a two-speed automatic transmission for controlling the second rotary engine, a second pilot valve connected to the transmission, a control valve in the second pilot valve, a motor connected to the control valve, a control line in the motor, first and second manometric switches in the control line, the first manometric switch being set to a lower pressure level, and the second manometric switch being set to a higher pressure level, a relay connecting each of the manometric switches to the control valve, an adjustable time-lag relay connected to the relay and a lock connected to the time-lag relay.

11. The device of claim 10, wherein the manometric switches are hydraulic valves having springs for actuating the hydraulic valves, and further comprising a hydraulic pressure valve connecting the hydraulic valves to the control valve, and having a reservoir and an adjustable throttle in the hydraulic pressure valve.

12. The device of claim 10, further comprising a shuttle valve integrated into the control line.

13. The device in of claim 10, further comprising a solenoid in the control valve, and a spring in the control valve said spring being in an off position when the device is not in operation.

14. The device claim 10, further comprising a mode selector having an automatic transmission and a manual switch, and plural luminous diodes on the mode selector for indicating individual switching positions.

* * * * *